US006693529B2

(12) United States Patent
Suzuki et al.

(10) Patent No.: US 6,693,529 B2
(45) Date of Patent: Feb. 17, 2004

(54) FIRE ALARM SYSTEM

(75) Inventors: Takashi Suzuki, Tokyo (JP); Takao Fujisawa, Tokyo (JP); Yuki Yoshikawa, Tokyo (JP); Kenth Sandell, Göteborg (SE)

(73) Assignee: Nittan Company Limited, Tokyo (JP)

( * ) Notice: Subject to any disclaimer, the term of this patent is extended or adjusted under 35 U.S.C. 154(b) by 33 days.

(21) Appl. No.: 09/929,026

(22) Filed: Aug. 15, 2001

(65) Prior Publication Data

US 2002/0024435 A1 Feb. 28, 2002

(30) Foreign Application Priority Data

Aug. 16, 2000 (JP) ..... P.2000-246943
Sep. 8, 2000 (JP) ..... P.2000-273458

(51) Int. Cl.[7] ..... G08B 29/00

(52) U.S. Cl. ..... 340/506; 340/508; 340/517; 340/521; 340/3.1

(58) Field of Search ..... 340/506, 508, 340/517, 521, 3.1, 825.36, 825.49, 286.01

(56) References Cited

U.S. PATENT DOCUMENTS 4,988,988 A * 1/1991 Kimura ..... 340/825.06
5,400,246 A * 3/1995 Wilson et al. ..... 340/3.1 X
5,402,101 A 3/1995 Berger et al. ..... 340/286.02

FOREIGN PATENT DOCUMENTS

EP 0734005 A1 9/1996
FR 2784775 4/2000

OTHER PUBLICATIONS

European Search Report dated May 14, 2003.

* cited by examiner

*Primary Examiner*—Daryl Pope
(74) *Attorney, Agent, or Firm*—Stevens, Davis, Miller & Mosher, LLP

(57) ABSTRACT

In a fire alarm system, a plurality of terminal equipments are connected to a control panel. A memory is provided with each terminal equipment, which stores characteristic data indicating characteristics of the associated terminal equipment. The control panel establishes an initial configuration of each terminal equipment based on the characteristic data transmitted from the respective terminal equipments.

19 Claims, 5 Drawing Sheets

FIG. 4

| ADDRESS | CONTENT |
|---|---|
| 0 x 01 | TYPE OF PRODUCT |
| 0 x 02 | TYPE OF ELEMENT |
| 0 x 03 | NORMAL VALUE |
| 0 x 04 | SENSITIVITY |
| 0 x 05 | HIGH FAULT |
| 0 x 06 | LOW FAULT |
| | |
| 0 x 07 | TYPE OF ELEMENT |
| 0 x 08 | NORMAL VALUE |
| 0 x 09 | SENSITIVITY |
| 0 x 0A | HIGH FAULT |
| 0 x 0B | LOW FAULT |
| | |
| 0 x 0C | TYPE OF ELEMENT |
| 0 x 0D | NORMAL VALUE |
| 0 x 0E | SENSITIVITY |
| 0 x 0F | HIGH FAULT |
| 0 x 10 | LOW FAULT |
| ⋮ | ⋮ |
| 0 x 1A | REPLY ADDRESS |

| HEADER | REPLY ADDRESS | COMMAND/DATA | CHECK SUM |
|---|---|---|---|

| HEADER | REPLY ADDRESS | COMMAND | MEMORY ADDRESS | CHECK SUM |
|---|---|---|---|---|

| HEADER | REPLY ADDRESS | CHARACTERISTIC DATA | CHECK SUM |
|---|---|---|---|

FIG. 7

| | |
|---|---|
| SETTING DATA | FIRST AREA |
| ADDRESS | |
| TYPE | SECOND AREA |
| SENSITIVITY | |
| CUSTOMER CODE | THIRD AREA |
| SERIAL NUMBER | |

FIG. 8

| LEVEL OF TERMINAL EQUIPMENT | CUSTOMER CODE | ALLOWABLE COMMAND |
|---|---|---|
| 0 (THIRD CASE) | $00_{16}$ | ANALOG VALUE OUTPUT, DIGITAL VALUE OUTPUT, ADDRESS SETTING AND ETC. |
| 1 (SECOND CASE) | $01_{16}$ ~ $FE_{16}$ | ALL COMMANDS EXCEPT WRITING OF TYPE, SENSITIVITY, SERIAL NUMBER OR CUSTOMER CODE |
| 2 (FIRST CASE) | $FF_{16}$ | ALL COMMANDS |

FIRE ALARM SYSTEM

BACKGROUND OF THE INVENTION

The present invention relates to a terminal equipment which performs disaster prevention under the control of a control panel, and a fire alarm system including the terminal equipment.

The present invention also relates to restriction of access to a memory in the terminal equipment.

Conventionally, a fire alarm system installed in a building or the like is configured mainly by a control panel which is disposed in a disaster prevention center or the like, and a plurality of terminal equipments such as fire detectors which are connected to the control panel via lines, and perform disaster prevention while exchanging predetermined command signals and data signals between the control panel and the terminal equipments by means of polling communication.

In such a fire alarm system, initialization of each of the terminal equipments is manually performed. In the case where the terminal equipment is a detector, for example, works of adjusting the sensitivity to a predetermined level depending on a detected object, i.e., smoke or heat, and, when the detector has a unique communication address, manually setting the address by using a dip switch must be conducted. In the control panel, furthermore, a work of matching the sensitivity level with each of the terminal equipments in accordance with the setting of the terminal equipments is required.

These works must be conducted not only in the initial start-up of the fire alarm system, but also in replacement of terminal equipments during maintenance or inspection. In a large fire alarm system in which several hundreds of terminal equipments are connected, an enormous amount of work must be conducted.

In such a fire alarm system, a nonvolatile memory may be disposed in each of terminal equipments, and various kinds of data such as the address and the sensitivity of the terminal equipment itself are stored in the memory. The provision of such a memory allows setting of various data to be easily performed by electrically rewriting the contents of the memory in a manufacturing stage of the terminal equipment or an installing stage of the fire alarm system. Therefore, it is not required to individually dispose a dip switch for setting an address, a circuit for adjusting the sensitivity, and the like, in terminal equipments.

Any person which is able to electrically access such a terminal equipment can perform rewriting or the like on a memory of the terminal equipment. Namely, not only a manufacturer who produces and manages the terminal equipment, but also a user who purchases the terminal equipment from the manufacturer and installs a fire alarm system, and an operator who operates the fire alarm system can access the terminal equipment. There is a possibility that various preset values in the memory may be freely changed by the user or the operator.

If the sensitivity of a detector and so on are freely changed by the operator or the like, there arises a probability that the fire alarm system itself cannot correctly act so that a false alarm and an alarm failure occur more frequently.

SUMMARY OF THE INVENTION

It is the first object of the invention to reduce the amount of work in start-up, maintenance, and inspection of a fire alarm system.

It is the second object of the invention to provide a fire alarm system of high reliability in which access to a memory disposed in a terminal equipment is restricted to prevent an inadequate change of settings and the like from occurring.

In order to achieve the above objects, according to the present invention, there is provided a terminal equipment, which is connected to a control panel and controlled by the control panel, comprising a memory, which stores characteristic data indicating characteristics of the terminal equipment.

In this configuration, a work of initializing the terminal equipment is substantially unnecessary when the terminal is installed into a fire alarm system, and when the terminal is replaced with another one, unlike the case where initialization is manually performed.

For example, the terminal equipments are various kinds of fire detectors, gas detectors, smoke control system, manual call points, local alarm bells, and the like. The characteristic data may include: product type of the terminal equipment, such as a detector or a smoke control system; type of element; and sensitivity (in the case of a detector); and a voltage level at which a smoke control system is activated (in the case of a smoke control system).

Preferably, the characteristic data is transmitted to the control panel. In this configuration, a work of initializing the terminal equipment in installation of a fire alarm system and replacement of the terminal equipment can be made substantially unnecessary, and the amount of work of initializing the control panel can be reduced.

The data may be transmitted from the terminal equipment to the control panel at the timing when the fire alarm system is activated. Each terminal equipment may be configured so as to transmit the characteristic data in response to a request signal from the control panel, or alternatively to transmit the characteristic data even when no request signal is sent from the control panel.

According to the invention, there is also provided a fire alarm system, comprising:

- a plurality of terminal equipments;
- a control panel, to which the terminal equipments are connected; and
- a memory, provided with each terminal equipment, which stores characteristic data indicating characteristics of the associated terminal equipment,
- wherein the control panel establishes an initial configuration of each terminal equipment based on the characteristic data transmitted from the respective terminal equipments.

In this configuration, a work of initializing the terminal equipment is substantially unnecessary when addition or attachment of the terminal equipment occurs in, for example, start-up of the fire alarm system, or replacement of the terminal equipment. Furthermore, also the work of initializing the control panel can be reduced.

Examples of the terminal equipments and the characteristic data are identical with those of the above. The predetermined are may be a single building, or a group consisting of plural buildings.

Preferably, the memory includes a non-volatile rewritable memory, and the characteristic data is stored in a predetermined address in the non-volatile rewritable memory. The characteristic data is transmitted to the control panel when the control panel requests the transmission while designating the predetermined address.

Here, it is preferable that the predetermined address is a common address to all the terminal equipments.

In the above configurations, the control panel instructs each terminal equipment to transmit the characteristic data with designating the address in place of the kind of data in the memory. When, in all the terminal equipments, a characteristic data is stored at the same address, the control panel is requested only to transmit the same instruction signal to all the terminal equipments, in order to collect characteristic data of the terminal equipments. Consequently, the process in the control panel can be simplified. When addresses of characteristic data in the terminal equipments, programs in the control panel and relating to initialization of the terminal equipments, and the physical structure (the number of wirings and the attachment portion) of a product are commonly set as described above among control panels and terminal equipments of different manufacturers, initialization between the control panel and each of the terminal equipments can be enabled simply by installing the terminal equipment in the same manner as so-called the plug and play.

Examples of the non-volatile rewritable memory are an EPROM (Erasable Programmable Read Only Memory), an EEPROM (Electrically EPROM), and a RAM (Random Access Memory) in which the power source is backed up.

Preferably, the control panel assigns an identification address to each terminal equipment to identify one terminal equipment from another.

Here, it is preferable that the control panel transmits a first address to the terminal equipments, prior to the assignment of the identification address. Each terminal equipment is provided with an initial address and a comparator which compares the initial address and the first address. Each terminal equipment rewrites the initial address into the assigned identification address when the comparator judges that the first address is coincident with the initial address.

In the above configurations, since the master receives can automatically assigns the identification addresses to the respective terminal equipments, it is possible to remarkably reduce the amount of work of initialization, unlike a case in which an address is manually set by using a dip switch.

According to the invention, there is also provided an access restricting method in a fire alarm system, comprising the steps of:

connecting a plurality of terminal equipments to a control panel, each terminal equipment including a memory;

assigning a level indicating access allowability from the control panel, to the memory in each terminal equipment; and providing a prohibition in the memory in each terminal equipment in accordance with the assigned access allowability level.

In this configuration, since the level is set according to relationships between the terminal equipment and the control panel, therefore, it is possible to prevent inadequate rewriting of data from occurring to attain a reliable fire alarm system.

Preferably, the prohibition providing step includes a step of determining a prohibited command transmitted from the control panel in accordance with the access allowability level.

Alternatively, the prohibition providing step includes a step of determining data which is writable by the control panel onto the memory, in accordance with the access allowability level.

In the above configurations, unauthorized access or rewriting by the control panel is prevented from occurring.

Here, it is preferable that the method further comprises the step of dividing the memory into a plurality of areas. The prohibition providing step includes a step of determining at least one area which stores the writable data, in accordance with the access allowability level.

Here, it is preferable that the level assigning step includes a step of writing data indicating the access allowability onto an area of exclusive use in the divided areas.

Here, it is preferable that the writing of the access allowability data is permitted for once. In this configuration, the level can be never rewritten so that unauthorized access or unauthorized rewriting can be certainly prevented from occurring.

Preferably, the access restriction is invalidated when a maintenance work for the terminal equipment is performed.

In this configuration, necessary access to or rewriting of data can be performed through the control panel or a maintenance device irrespective of the assigned level.

However, it does not mean that the control panel or the maintenance device can access the memory of each terminal equipment without any restriction.

In the specification, the term "maintenance" includes maintenance, inspection, repair, replacement, etc.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIG. 4 is a view showing an example of characteristic data stored in an EEPROM in the control circuit shown in FIG. 3;

FIG. 7 is a diagram showing contents written into an EEPROM in the control circuit shown in FIG. 6; and FIG. 8 is a diagram illustrating levels of the terminal equipment.

DETAILED DESCRIPTION OF THE PREFERRED EMBODIMENTS

Hereinafter, preferred embodiments of the invention will be described with reference to the accompanying drawings.

Figure 1:
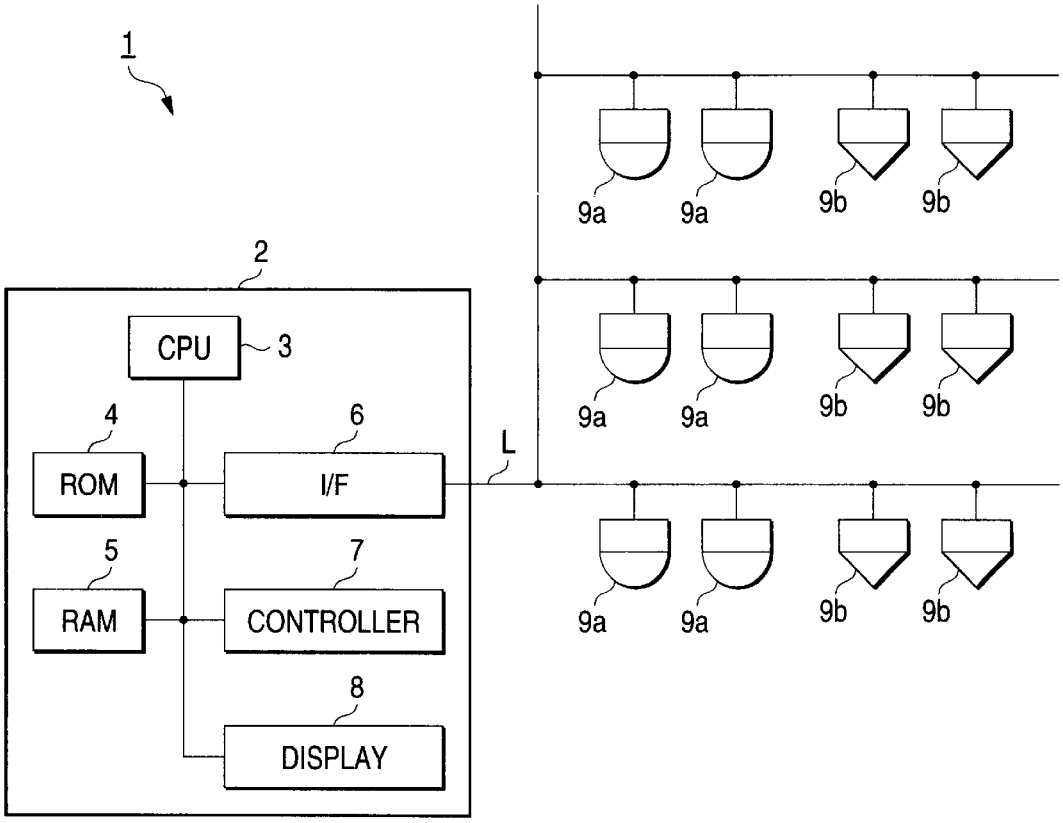
FIG. 1 is a block diagram schematically showing an example of the fire alarm system of the invention.

FIG. 1 is a block diagram schematically showing the configuration of the fire alarm system of the invention. The fire alarm system 1 is installed in a building or the like to perform disaster prevention such as fire monitoring and alarming, and configured mainly by a control panel 2, and terminal equipments 9*a* and 9*b* which are connected to the control panel 2 via lines L, and which are respectively disposed in some areas in the building. In the fire alarm system 1, commands and data are transmitted and received by means of polling communication in which the control panel 2 is set as a master and the terminal equipments 9*a* are set as slaves.

The control panel 2 is disposed in, for example, a disaster prevention center or a building manager office, and controls and manages the operation of the fire alarm system 1. The control panel includes a CPU (Central Processing Unit) 3, a ROM (Read Only Memory) 4, a RAM (Random Access Memory) 5, an interface 6 which relays transmission to and reception from the terminal equipments 9*a* and 9*b*, a controller 7, and a display 8. The controller 7 is configured by various switches, buttons, and the like, and the display 8 includes a liquid crystal display screen, LED (Light Emitting Diode) indicator lamps, etc.

The ROM 4 stores control programs and control data for controlling the whole of the fire alarm system 1, and, as descried later, also characteristic data or like data transmitted from the terminal equipments 9*a* and 9*b* and historical information of the fire alarm system 1.

The CPU 3 controls various kinds of operations in the fire alarm system 1 with using the RAM 5 as a work area, in accordance with the control programs and the control data stored in the ROM 4. For example, the CPU 3 gives to each of the terminal equipments a reply address (identification address) for identifying the terminal equipment, at the timing when the fire alarm system 1 is activated.

Figure 2:
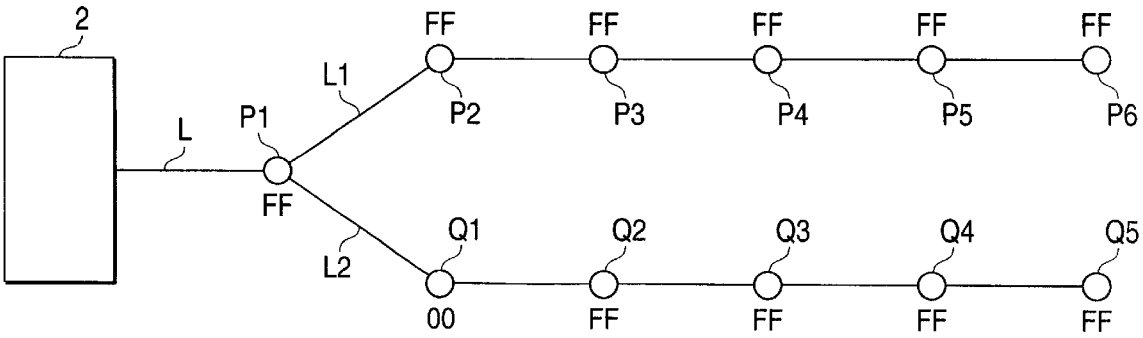
FIG. 2 is a diagram illustrating a method of automatic addressing.

FIG. 2 diagrammatically shows this automatic addressing. In this figure, terminal equipments which are connected to the control panel 2 via the lines L are indicated by circles. For the sake of convenience, terminal equipments connected to a line L1 are denoted by P1, P2, . . . , P6, and terminal equipments connected to a line L2 are denoted by Q1, Q2, . . . , Q5.

As shown in FIG. 2, before the fire alarm system 1 is activated, "FF" is set as a provisional address to most of the terminal equipments. However, another provisional address or "00" is set only to the terminal equipment Q1 which is in the forefront of the line L2. When provisional addresses are set in this manner, a circuit in each of the terminal equipments which is to be connected to the adjacent terminal equipment in the side opposite to the control panel 2 is opened so that a signal is not transmitted to the adjacent terminal equipment. In the initial stage, namely, only the terminal equipment P1 which is in the forefront of the line L1 is connected to the control panel 2.

Each of the terminal equipments comprises a comparator which compares a reply address transmitted from the control panel 2 with its own address. If the addresses coincide with each other, the terminal equipment accepts a signal which is then transmitted from the control panel 2.

When the fire alarm system 1 is activated, the control panel 2 first transmits an "FF" signal to the terminal equipment P1. The terminal equipment P1 compares the "FF" signal with its own current address "FF". In this case, coincidence is attained, and hence the terminal equipment is set to a state where the terminal equipment accepts a signal which is then transmitted from the control panel 2. Thereafter, the control panel 2 transmits an address data signal, and the terminal equipment P1 rewrites its own address as directed by the address data signal, and closes the circuit which is connected to the adjacent terminal equipment P2. As a result, the terminal equipment P2 is connected to the control panel 2, and the same process as that on the terminal equipment P1 is performed so that the address is given to the terminal equipment P2. At the same time when the terminal equipment P2 is connected to the control panel, also the terminal equipment Q1 is connected to the control panel. However, the terminal equipment Q1 does not react to the "FF" signal.

By repeating the above process, the control panel 2 gives sequentially the reply address to the terminal equipments P1, P2, . . . , P5, and P6.

When the setting of the reply address to the terminal equipment P6 is ended and there is no further terminal equipment accepting the transmission of the "FF" signal, the control panel 2 transmits a "00" signal. The terminal equipment Q1 compares the "00" signal with its own current address "00". In this case, coincidence is attained, and hence the terminal equipment is set to a state where the terminal equipment accepts a signal which is then transmitted from the control panel 2. Thereafter, the control panel 2 transmits an address data signal, and the terminal equipment Q1 resets its own address to the data of the signal and closes the circuit which is connected to the adjacent terminal equipment Q2. Thereafter, the control panel 2 gives sequentially the address to the terminal equipments Q2 to Q5 while repeatedly transmitting the "FF" signal and the address data signal. In this way, unique identification addresses are given to the terminal equipments, respectively.

When the above-mentioned automatic addressing is finished, the CPU 3 instructs each of the terminal equipments 9*a* and 9*b* to transmit theirs characteristic data as described later. The characteristic data which are transmitted as a reply from the terminal equipments are stored into the RAM 5. In accordance with the data, the CPU initializes the control panel 2.

Examples of the terminal equipments 9*a* and 9*b* are provided as, for example, a repeater which relays communication between the control panel 2 and an on/off type detector, an analog type fire detector, a smoke control system such as a fire door, a manual call point, and a local alarm bell. Each of the terminal equipments 9*a* and 9*b* is operated under the control of the control panel 2, and, as described above, is provided with the unique address, so as to individually communicate data with the control panel 2 via the lines L while an electric power is supplied from the control panel 2.

Figure 3:
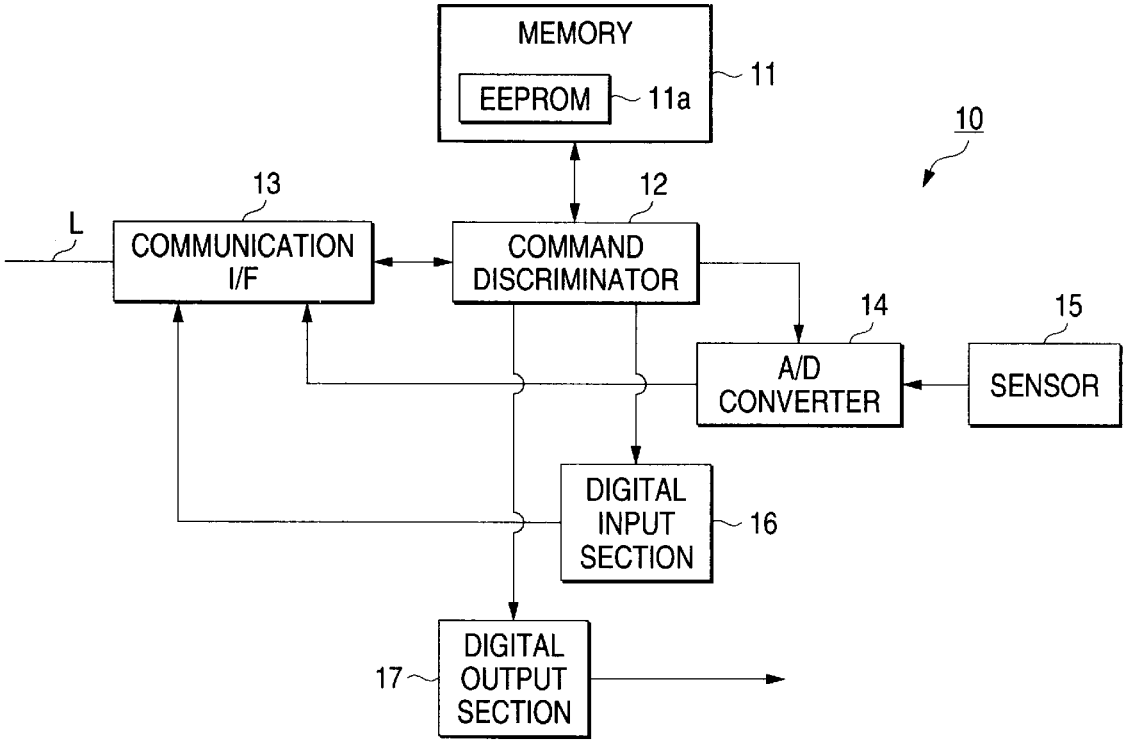
FIG. 3 is a block diagram schematically showing a control circuit of a terminal equipment according to a first embodiment of the invention.

FIG. 3 is a block diagram of a control circuit 10 according to a first embodiment of the present invention, which is incorporated into each of the terminal equipments 9*a* and 9*b*. The control circuit 10 is configured by, for example, a one-chip IC (Integrated Circuit), and includes a memory 11, a command discriminator 12, a communication interface 13, an A/D converter 14, a sensor 15, a digital input section 16, and a digital output section 17. The block diagram of FIG. 3 diagrammatically shows the configuration common to the terminal equipments.

The communication interface 13 is connected to the line L to relay signals communicated with the control panel 2.

The command discriminator 12 discriminates command information which is transmitted from the control panel 2 via the communication interface 13, and, in accordance with the contents of the command, transmits predetermined signals to the memory 11, the A/D converter 14, the digital input section 16, and the digital output section 17, respectively.

When a signal conversion command from the command discriminator 12 is given to the A/D converter 14, the A/D converter converts an analog signal detected by the sensor 15, into a digital signal, and outputs the digital signal.

In response to a command from the command discriminator 12, the digital input section 16 captures a digital value, and then transmits the digital value to the control panel 2. For example, the operation state of the terminal equipment in the case where the terminal equipment is a manual call point, or digital data in the case where digital data are collected in the detection of a fire may be used as the digital value to be captured.

The digital output section 17 receives a command from the command discriminator 12 to output a digital signal for an operation such as lighting of the indicator lamps, or sounding of a bell.

The memory 11 stores various kinds of data necessary for operating the terminal equipment, and includes, for example, a rewritable EEPROM 11*a* (Electrically Erasable Programmable Read Only Memory) and a RAM (not shown) which temporarily stores a reply address and a command from the control panel 2. The memory 11 outputs the stored data in response to a request from the command discriminator 12.

The EEPROM 11*a* has a capacity of, for example, 128 bytes. One address is given to every byte (such an address is referred to as a memory address). A characteristic data specific to the terminal equipment is stored at a predetermined memory address.

In most of the terminal equipments 9*a* and 9*b* disposed in the fire alarm system 1, the control circuit 10 shown in FIG. 3 is disposed, and the memory address in the EEPROM 11*a* at which the characteristic data is written is unified.

FIG. 4 shows an example of the characteristic data stored in the EEPROM 11*a* in the case where the terminal equipment is a fire detector. The detector can receive three inputs of analog data. Among addresses, "0X01" stores type of product such as a smoke detector, a heat detector or a multi-sensor fire detector. Type of element as a sensor, such as a heat sensor, a photoelectric smoke sensor, a flame sensor, a carbon monoxide sensor, are stored at "0X02", "0X07", and "0X0C". However, the type of element is not always stored at all the three addresses. In the case where one or two detectors are disposed in the terminal equipment, the type of element is correspondingly written at one or two addresses.

Specific data relating to the type of element written at "0X02", "0X07", and "0X0C" are written at "0X03 to 0X06", "0X08 to 0X0B", and "0X0D to 0X10". "Normal value" indicates the value of an analog data which is output from the corresponding sensor in a normal monitoring state, and "sensitivity" indicates the value of an analog data at which it is judged that a fire occurs. In the case where the type of element is a thermistor of a heat detector, a voltage value corresponding to, for example, 25° C. is set as "normal value", and a voltage value corresponding to 57° C. is stored as the value of "sensitivity". "high fault" is a threshold for judging that trouble is occurred on the terminal equipment when a value higher than the threshold is detected, and "low fault" is a threshold for judging that trouble is occurred on the terminal equipment when a value lower than the threshold is detected.

When the fire alarm system 1 is activated, the control panel 2 automatically gives the reply address to each of the terminal equipments as described above, and the address is stored at memory address "0X1A" as shown in the lower portion of FIG. 4.

After the reply addresses are given, the control panel 2 sends a characteristic data request signal to the terminal equipments 9*a* and 9*b* so that the characteristic data stored in the memory address of the EEPROM 11*a* is transmitted. In response to the signal, each of the terminal equipments transmits the characteristic data signal such as shown in FIG. 4 to the control panel 2. In accordance with the received characteristic data signal, in the control panel 2, initialization of the control panel 2 is automatically performed in which, for example, in the case where the terminal equipment is a fire detector, the voltage level of a signal for judging occurrence of a fire is controlled, or, in the case where the terminal equipment is a smoke control system, the control timing and the voltage level are adjusted.

Figures 5A, 5B, 5C, 6:
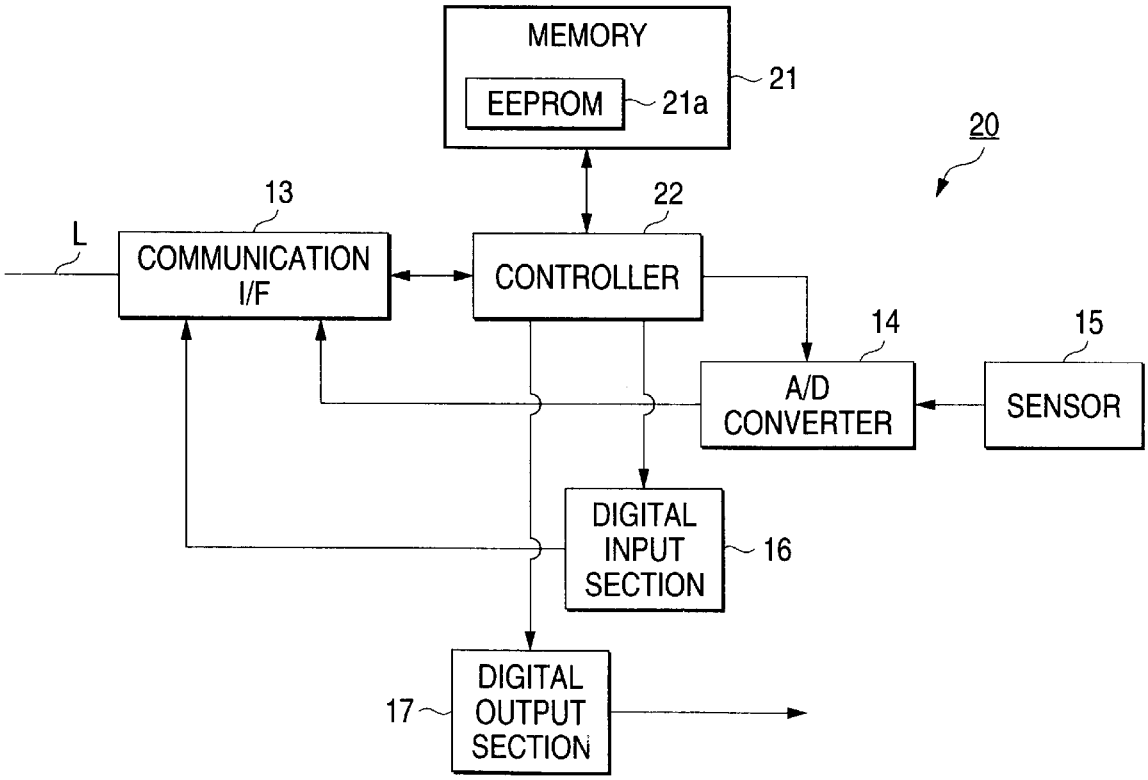
FIGS. 5A to 5C are views showing configurations of a communication protocol between a control panel and the terminal equipment.
FIG. 6 is a block diagram schematically showing a control circuit of a terminal equipment according to a second embodiment of the invention.

In the embodiment, the data communication between the control panel 2 and the terminal equipments is performed basically according to the protocol shown in FIG. 5A. Namely, a communication format is used in which, after a header and the reply address of the terminal equipment, a command and data are added, and a check sum is finally added. As required, control data or the like may be added to the command.

The check sum is added to the signal in order to enhance the reliability of the transmission message, and has a configuration of "header+address+command+customer code". The customer code will be described later.

FIGS. 5B and 5C show protocols used in the above-mentioned characteristic data communication. As shown in FIG. 5B, the control panel 2 transmits a command requesting a characteristic data, subsequent to the header and the reply address, the memory address of the EEPROM 11*a* is added, and the check sum is finally added.

The signal of FIG. 5B is received by the terminal equipment in which the designated reply address is set. In response to this reception, as shown in FIG. 5C, the designated terminal equipment transmits the header, the reply address of the terminal equipment itself, the characteristic data written at the memory address which is designated in FIG. 5B, and the check sum.

The characteristic data stored at one memory address is transmitted by one communication. When there are plural characteristic data to be transmitted, the exchange of the signals shown in FIGS. 5B and 5C is repeatedly performed.

According to the above-described fire alarm system 1, since the control panel 2 automatically assigns the identification address to the respective terminal equipments, unlike a conventional system in which an address is manually set by using a dip switch, therefore, the work of setting the address is made unnecessary. Thereby, it is possible to remarkably reduce the amount of work required for the system initialization.

In addition, since each of the terminal equipments 9*a* and 9*b* comprises the EEPROM 11*a* for storing a characteristic data indicating characteristics of the terminal equipment itself, and the control panel 2 controls each of the terminal equipments so as to transmit the characteristic data, and performs initialization relating to the terminal equipment on the basis of the received characteristic data. Therefore, a work of initializing the terminal equipment is substantially unnecessary when addition or attachment of the terminal equipment occurs in, for example, start-up of the fire alarm system 1, or replacement of the terminal equipment. Furthermore, also the amount of work required for initializing the control panel 2 can be reduced.

In the characteristic data communication, the control panel 2 designates the predetermined memory address in the EEPROM 11*a*, and instructs so as to transmit contents at the address. Namely, the control panel 2 instructs each terminal equipment to transmit the characteristic data with designating the place in the EEPROM 11*a* instead of the type of data. When, in all the terminal equipments which are controlled by the control panel 2, the characteristic data is stored at the same memory address, therefore, the control panel 2 is requested only to transmit the same instruction signal to all the terminal equipments, in order to collect the characteristic data of the terminal equipments. Consequently, the process required in the control panel can be simplified. When memory addresses of characteristic data in the terminal equipments, programs in the control panel and relating to initialization of the terminal equipments, and the physical structure (the number of wirings and the attachment portion) of a product are commonly shared among control panels and terminal equipments of different manufacturers, initialization between the control panel and each of the terminal equipments can be enabled simply by installing the terminal equipment in the same manner as so-called "plug and play".

It is a matter of course that the fire alarm system 1 of the invention is not limited to the embodiment described above, and may be adequately modified in specific configuration, function, and the like.

For example, the memory may be configured by any kind of rewritable memory which is substantially nonvolatile. Various kinds of ROMs, or a RAM in which the power source is backed up may be used as the memory.

The characteristic data shown in FIG. 4 is mere one example. Even in the case of a fire detector, other kinds of data may be stored. With respect to characteristic data of a different type of terminal equipment such as a smoke control system, the number of items to be stored and specific contents are different from those of the illustrated example.

The method of automatically setting the reply addresses of the terminal equipments by the control panel is not restricted to that shown in FIG. 2.

The reply addresses of the terminal equipments are not restricted to those which are automatically set by the control panel. For example, a reply address may be previously stored into an EEPROM of a terminal equipment, and, when the terminal equipment is activated, the terminal equipment may transmit the reply address to the control panel. In this case, the reply address in the EEPROM may be derived from an address which is set by the operator through a dip switch.

In start-up of the whole of the fire alarm system, the control panel automatically may give an address to each of the terminal equipments, and, when one of the terminal equipments is replaced with a new one for maintenance, inspection, or the like, the control panel may automatically set the reply address of the terminal equipment which has been originally disposed in this place, to the new terminal equipment which is disposed as a result of the replacement, or the operator may set the reply address.

In the case where the terminal equipment is a fire detector, a sensor part may be configured so as to be detachable. In this case, the memory which stores characteristic data may be incorporated into the sensor part, whereby replacement of the terminal equipment can be easily conducted by simply replacing only the sensor part.

Next, a second embodiment of the invention will be described. FIG. 6 is a block diagram of a control circuit 20 incorporated into each terminal equipment in this embodiment. Parts identical with the first embodiment are designated the same reference numerals, and detailed explanation are omitted here.

A memory 21 stores various kinds of data necessary for operating the terminal equipment, and is provided as a nonvolatile rewritable memory. The memory 21 includes, for example, an EEPROM 21*a,* a RAM (not shown) which temporarily stores a reply address and a command from the control panel 2, and the like, and outputs the stored data in response to a request from a controller 22.

FIG. 7 shows an example of the contents written into the EEPROM 21*a* in the case where the terminal equipment is a fire detector. As shown in this figure, the EEPROM 21*a* can be divided into three areas (a first area, a second area, and a third area). "Setting data" and "address" are written into the first area, "type" and "sensitivity" are written into the second area, and "customer code" and "serial number" are written into the third area (exclusive use area).

These three areas indicate allowability of access or writing by the control panel in accordance with a level assigned to the terminal equipment.

"Setting data" include various kinds of data such as output conditions for outputting analog values to the control panel, and output conditions relating to the output of digital values. "Address" is a unique address which is preset to each of the terminal equipments. "Type" indicates an object detected by the terminal equipment, i.e., smoke, heat, or the like. "Sensitivity" indicates the sensitivity of fire detection. "Customer code" is set to the terminal equipment in accordance with the control panel to which the terminal equipment is connected, and determines the level of the terminal equipment. The customer code and the level will be described later. "Serial number" indicates a lot number or an individual product number, and is recorded by the manufacturer when the detector is manufactured or shipped.

The "customer code" is set to each of users of terminal equipments in order to classify terminal equipments in accordance with the level.

In a fire alarm system, usually, relationships between a control panel and terminal equipments are not always identical with one another. For example, there is a case where a control panel to which a terminal equipment is to be connected is a product of the manufacturer (terminal equipment manufacturer) who produces or manages the terminal equipment, and completely corresponds to the terminal equipment (first case). There is another case where a control panel partly corresponds to a terminal equipment and is produced by the terminal equipment manufacturer itself or another manufacturer (second case). In a further case, a terminal equipment is individually sold and then supplied via an agent or the like to a manufacturer who constructs a fire alarm system, and therefore it is impossible to previously know the kind of the control panel to which the terminal equipment is connected (third case).

In the first case, even when most of contents of the EEPROM 21*a* are disclosed to the control panel, or rewritten by the control panel, it is not a problem for the terminal equipment manufacturer. The second case is not preferable to the terminal equipment manufacturer because, when important data such as the sensitivity are rewritten, the reliability of the terminal equipment, and hence that of the fire alarm system are adversely affected. Consequently, access to data must be restricted to a certain degree. In the third case, the kind of the control panel to which the terminal equipment is connected is entirely unknown to the terminal equipment manufacturer, and hence it is desired to allow only minimum data which are required in disaster prevention, to be accessed.

Because of these reasons, in the terminal equipments of the embodiment, access restriction is made in the following manner. With respect to data in the EEPROM 21*a,* as shown in FIG. 8, access restriction is imposed on various commands and writing for each of objective control panels. In the embodiment, no restriction is imposed on reading of the data in the EEPROM 21*a*.

Namely, terminal equipments corresponding to the third case are set to "level 0", those corresponding to the second case are set to "level 1", and those corresponding to the first case are set to "level 2".

In the case of a terminal equipment of level 0, "$00_{16}$" is set as the customer code in the EEPROM 21*a*. In this case, commands which can be accepted by the terminal equipment are restricted, or limited to only minimum commands which are required in disaster prevention, such as a command to read an analog value (a command of transmission to the control panel), checking of the contents of various data, and writing of an address. Namely, with respect to writing, an address change only is enabled, and a change of other data (various conditions) is never allowed. When the control panel transmits a command which is not allowed, the terminal equipment nullifies the command and replies with the error data.

In the case of a terminal equipment of level 1, one of "$01_{16}$" to "$FE_{16}$" is set as the customer code.

The terminal equipment of level 1 can accept all commands other than writing of the type, the sensitivity, the serial number, and the customer code. Namely, the control panel 2 is enabled to write all data in the first area of FIG. 7. For example, commands which are not allowed to the terminal equipment of level 0, and which are allowed to the terminal equipment of level 1 include an instruction for reading a digital signal the transmission speed of which is higher than a normal one, and a command for calling terminal equipments in a group unit.

When a command for writing to the second or third area is given, the command is nullified and the error data is returned.

In the case of a terminal equipment of level 2, "$FF_{16}$" is set as the customer code. In the terminal equipment of level 2, all commands and writing from the control panel 2 are allowed. The third area is rewritable only once after production. Therefore, the control panel is usually enabled to perform writing on the first and second areas.

The controller 22 analyzes a command signal which is transmitted from the control panel 2 via the communication interface 13. First, the controller 22 judges whether the address in the command signal from the control panel 2 coincides with the own address in the EEPROM 21*a* or not. The controller 22 further judges whether the customer code in the check sum of the command signal coincides with the own customer code or not. Only when coincidences of both the address and the customer code are attained, the control section accepts the command signal from the control panel 2, and, in accordance with the contents of the command signal, transmits predetermined signals to the memory 21, the A/D converter 14, the digital input section 16, and the digital output section 17, respectively.

In a terminal equipment of any level, if the address in a command signal from the control panel 2 coincides with the own address, the customer code coincides with the own customer code, and the command signal corresponds to the level or is allowed, an operation according to the command signal is performed, and a necessary reply signal is transmitted to the control panel 2.

During maintenance of the fire alarm system 1, a maintenance worker accesses the control circuit 20 of one of the terminal equipments, and connects the maintenance terminal (not shown) to the ground, whereby the terminal equipment is caused to enter a maintenance mode. In the maintenance mode, even when the customer code of the terminal equipment is level 0 or 1, the above-mentioned access restriction is not established, and the control panel 2 is enabled to perform writing on the first and second areas of FIG. 7. The switching to the maintenance mode may be performed by a mechanical method using a switch or a jumper, in place of the connection of the maintenance terminal to the ground.

The maintenance of the terminal equipment can be performed not only by the control panel, also by a well-known tester. Also in the latter case, in the same manner as the maintenance by the control panel, when the terminal equipment is switched to the maintenance mode, predetermined maintenance and inspection can be conducted without being subjected access restriction which is determined by the customer code of the terminal equipment.

In the terminal equipment of the embodiment, in the manufacturing stage, "$FF_{16}$" is set as the default value of the customer code. Thereafter, the various kinds of data in the EEPROM 21*a* shown in FIG. 7 are initialized by the terminal equipment manufacturer. At this time, also the customer code is set in accordance with the state of the terminal equipment, or one of the above-mentioned first, second, and third cases. If the terminal equipment state is the first case, the customer code is maintained to "$FF_{16}$". If the second case, one of "$01_{16}$" to "$FE_{16}$" is set, and, if the third case, the customer code is set to "$00_{16}$". Also the serial number is written into the area at this time. The customer code and the serial number in the third area of FIG. 7 are rewritable only once.

As has been described heretofore, according to this embodiment, one of level 0, level 1, and level 2 is assigned to each of the terminal equipments 9*a* and 9*b* and, in accordance with the level, restrictions of the writable area in the EEPROM 21*a* and allowable commands are imposed on the control panel 2. When the level of each terminal equipment is set according to relationships between the terminal equipment and the control panel, therefore, it is possible to prevent inadequate access to the EEPROM 21*a*, unauthorized rewriting, and the like from occurring. Consequently, the reliability of the fire alarm system 1 is improved.

Since the third area is rewritable only once, the end user cannot perform unauthorized rewriting such as that level 0 is changed to level 1. In this point also, it is possible to prevent unauthorized access or rewriting from occurring.

The invention is not limited to the embodiment described above. For example, another case(s) may be additionally assumed to set four or more levels. Alternatively, levels 1 and 2 may be unified into one level. With respect to the division into areas, the number of areas, and the kinds of data which are to be written into the areas may be appropriately determined.

What is claimed is:

1. A terminal equipment, which is connected to a control panel and controlled by the control panel in a usual state, the terminal equipment comprising a memory, which stores characteristic data indicating characteristics of the terminal equipment, wherein the characteristic data is directly transmitted to the control panel.

2. The terminal equipment as set forth in claim 1, wherein the characteristic data is transmitted in accordance with a request issued from the control panel.

3. The terminal equipment as set forth in claim 1, wherein the memory includes a non-volatile rewritable memory, and the characteristic data is stored in the non-volatile rewritable memory.

4. A fire alarm system, comprising:

a plurality of terminal equipments;

a control panel, to which the terminal equipments are connected in a usual state; and a memory, provided with each terminal equipment, which stores characteristic data indicating characteristics of the associated terminal equipment, wherein the control panel establishes an initial configuration of each terminal equipment based on the characteristic data directly transmitted from the respective terminal equipments.

5. The fire alarm system as set forth in claim 4, wherein the memory includes a non-volatile rewritable memory, and the characteristic data is stored in a predetermined address in the non-volatile rewritable memory; and wherein the characteristic data is transmitted to the control panel when the control panel requests the transmission while designating the predetermined address.

6. The fire alarm system as set forth in claim 5, wherein the predetermined address is a common address to all the terminal equipments.

7. The fire alarm system as set forth in claim 4, wherein the control panel assigns an identification address to each terminal equipment to identify one terminal equipment from another.

8. The fire alarm system as set forth in claim 7, wherein the control panel transmits a first address to the terminal equipments, prior to the assignment of the identification address;

wherein each terminal equipment is provided with an initial address and a comparator which compares the initial address and the first address; and wherein each terminal equipment rewrites the initial address into the assigned identification address when the comparator judges that the first address is coincident with the initial address.

9. The fire alarm system as set forth in claim 4, wherein the characteristic data includes data indicating access allowability from the control panel.

10. The fire alarm system as set forth in claim 9, wherein the memory is divided into a plurality of areas; and wherein the access allowability data is stored in an area of exclusive use in the divided areas.

11. The fire alarm system as set forth in claim 10, wherein the area of exclusive use is rewritable for once.

12. The fire alarm system as set forth in claim 9, wherein the access allowability data is invalidated when a maintenance work for the terminal equipment is performed.

13. An access restricting method in a fire alarm system, comprising the steps of:

connecting a plurality of terminal equipments to a control panel, each terminal equipment including a memory;

assigning a level indicating access allowability from the control panel, to the memory in each terminal equipment; and providing a prohibition in the memory in each terminal equipment in accordance with the assigned access allowability level.

14. The access restricting method as set forth in claim 13, wherein the prohibition providing step includes a step of determining a prohibited command transmitted from the control panel in accordance with the access allowability level.

15. The access restricting method as set forth in claim 13, wherein the prohibition providing step includes a step of determining data which is writable by the control panel onto the memory, in accordance with the access allowability level.

16. The access restricting method as set forth in claim 15, further comprising the step of dividing the memory into a plurality of areas, wherein the prohibition providing step includes a step of determining at least one area which stores the writable data, in accordance with the access allowability level.

17. The access restricting method as set forth in claim 16, wherein the level assigning step includes a step of writing data indicating the access allowability onto an area of exclusive use in the divided areas.

18. The access restricting method as set forth in claim 17, wherein the writing of the access allowability data is permitted for once.

19. The access restricting method as set forth in claim 13, wherein the access restriction is invalidated when a maintenance work for the terminal equipment is performed.

* * * * *